US006769761B2

(12) United States Patent
Beilman et al.

(10) Patent No.: US 6,769,761 B2
(45) Date of Patent: Aug. 3, 2004

(54) INKJET PRINTER HAVING INK CARTRIDGE TAPE REMOVAL CAPABILITY AND METHOD OF ASSEMBLING THE PRINTER

(75) Inventors: Thomas R. Beilman, Salem, OR (US); Bonnie Scherich, Corvallis, OR (US); Majid Shirazi, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/233,194

(22) Filed: Aug. 29, 2002

(65) Prior Publication Data

US 2004/0041887 A1 Mar. 4, 2004

(51) Int. Cl.[7] ..... B41J 2/135
(52) U.S. Cl. ..... 347/44; 347/29; 347/87
(58) Field of Search ..... 347/86, 87, 29, 347/33, 44

(56) References Cited

U.S. PATENT DOCUMENTS

| | | | | |
|---|---|---|---|---|
| 3,946,398 A | | 3/1976 | Kyser et al. | |
| 4,369,456 A | * | 1/1983 | Cruz-Uribe et al. | 347/33 |
| 4,381,946 A | | 5/1983 | Uehara et al. | |
| 4,500,895 A | | 2/1985 | Buck | |
| 4,771,295 A | | 9/1988 | Baker et al. | |
| 4,794,409 A | | 12/1988 | Cowger et al. | |
| 5,231,416 A | | 7/1993 | Terasawa et al. | |
| 5,262,802 A | | 11/1993 | Karita et al. | |
| 5,278,584 A | | 1/1994 | Keefe et al. | |
| 5,572,245 A | * | 11/1996 | Cowger | 347/44 |
| 5,648,802 A | | 7/1997 | Abe | |
| 5,812,166 A | | 9/1998 | Yamazaki | |
| 5,850,238 A | | 12/1998 | Karita et al. | |
| 6,062,390 A | | 5/2000 | Nakamura | |
| 6,260,942 B1 | | 7/2001 | Ahne et al. | |
| 6,305,786 B1 | | 10/2001 | Plotkin et al. | |
| 6,409,325 B1 | | 6/2002 | Matsumoto et al. | |

* cited by examiner

*Primary Examiner*—Anh T. N. Vo

(57) ABSTRACT

An inkjet printer having ink cartridge tape removal capability and method of assembling the printer. The printer comprises a frame and a slide bar attached to the frame. A carriage holding a plurality of ink cartridges is adapted to slidably translate along the slide bar. Each ink cartridge has a plurality of ink ejection orifice for ejecting ink drops therefrom. A take-up reel is connected to the frame, the take-up reel having a protective tape extending therefrom and adhesively adhering to the ink cartridges so as to cover the ink ejection orifices. Purpose of the tape is to prevent dirt, dust and other particulate matter from entering the ink ejection orifices during transport and storage of the printer and prior to first operation of the printer. When an end user of the printer first operates the printer, the carriage translates along the slide bar away from the take-up reel. As the carriage translates along the slide bar, the tape peels from the cartridges and exposes the ink ejection orifices because the take-up reel anchors one end of the protective tape as the other end of the tape is free to peel from the cartridges. Engaging the take-up reel is an actuator. The actuator operates the take-up reel, so that the protective tape winds about the take-up reel after peeling from the cartridges in order to avoid interference with movement of the carriage during printing.

23 Claims, 15 Drawing Sheets

INKJET PRINTER HAVING INK CARTRIDGE TAPE REMOVAL CAPABILITY AND METHOD OF ASSEMBLING THE PRINTER

BACKGROUND OF THE INVENTION

This invention generally relates to apparatus and methods of protecting ink ejection orifices of inkjet printer cartridges with protective tape, and more particularly relates to an inkjet printer having ink cartridge tape removal capability and method of assembling the printer.

An inkjet printer produces images on a recorder medium by ejecting ink drops onto the recorder medium in an image-wise fashion. The advantages of non-impact, low-noise, low energy use, and low cost operation, in addition to the ability of the printer to print on plain paper are largely responsible for the wide acceptance of inkjet printers in the marketplace.

Inkjet printers comprise a print head including a plurality of ink cartridges, each ink cartridge having a plurality of ink ejection orifices. At every orifice a pressurization means is used to produce an ink drop. In this regard, either one of two types of pressurization means may be used. These two types of pressurization means are heat pressurization means and piezoelectric pressurization means. With respect to piezoelectric pressurization means, a piezoelectric material is used. The piezoelectric material possesses piezoelectric properties such that an electric field is produced when a mechanical stress is applied. The converse also holds true; that is, an applied electric field will produce a mechanical stress in the material. When a piezoelectric pressurization means is used for inkjet printing, an electric pulse is applied to the piezoelectric material causing the piezoelectric material to bend, thereby squeezing an ink drop from an ink body in contact with the piezoelectric material. The ink drop thereafter travels toward and lands on the recorder medium to place a mark on the recorder medium. One such piezoelectric inkjet printer is disclosed by U.S. Pat. No. 3,946,398 titled "Method And Apparatus For Recording With Writing Fluids And Drop Projection Means Therefor" issued Mar. 23, 1976 in the name of Edmond L. Kyser, et al.

With respect to heat pressurization means, such as found in thermal inkjet printers, a heater heats the ink and a quantity of the ink phase changes into a gaseous steam bubble. The steam bubble raises the internal ink pressure sufficiently for an ink drop to be expelled towards the recorder medium. Thermal inkjet printers are well-known and are discussed, for example, in U.S. Pat. Nos. 4,500,895 to Buck, et al.; 4,794,409 to Cowger, et al.; 4,771,295 to Baker, et al.; 5,278,584 to Keefe, et al.; and the Hewlett-Packard Journal, Vol. 39, No. 4 (August 1988), the disclosures of which are all hereby incorporated by reference.

The print head itself may be a carriage mounted print head that reciprocates transversely with respect to the recorder medium (i.e., across the width of the recorder medium) as a controller connected to the print head selectively fires individual ones of the ink ejection orifices, in order to print a swath of information on the recorder medium. After printing the swath of information, the printer advances the recorder medium the width of the swath and the print head prints another swath of information in the manner mentioned immediately hereinabove. This process is repeated until the desired image is printed on the recorder medium. Alternatively, the print head may be a page-width print head that is stationary and that has a length sufficient to print across the width of the recorder medium. In this case, the recorder medium is moved continually and normal to the stationary print head during the printing process.

Inks useable with piezoelectric and thermal inkjet printers, whether those printers have carriage-mounted or page-width print heads, are specially formulated to provide suitable images on the recorder medium. Such inks typically include a colorant, such as a pigment or dye, and an aqueous liquid, such as water, and/or a low vapor pressure solvent. More specifically, the ink is a liquid composition comprising a solvent or carrier liquid, dyes or pigments, humectants, organic solvents, detergents, thickeners, preservatives and other components. Once applied to the recorder medium, the liquid constituent of the ink is removed from the ink by evaporation or polymerization in order to fix the colorant to the recorder medium. Various liquid ink compositions are disclosed, for example, by U.S. Pat. No. 4,381,946 titled "Ink Composition For Ink-Jet Recording" issued May 3, 1983 in the name of Masafumi Uehara, et al.

Frequently, the inkjet printer includes an ink cartridge when the printer is shipped from the manufacturer. The printer includes the cartridge for the convenience of the end user of the printer. In this manner, the end user need not separately purchase the cartridge before beginning operation of the printer. Rather, the end user merely needs to retrieve the printer from a shipping container, connect the printer to a source of electrical power and to an image source, insert paper, install the ink cartridge in the printer and then begin using the printer.

However, it is important during transport and storage of the printer to temporarily seal the ink ejection orifices against ingress of air and also dirt, dust and other particulate matter. Prolonged contact of the ink with air may evaporate preservatives present in the ink thereby drying-out the ink. Excessive drying-out of the ink substantially increases viscosity of the ink such that the ink obtains less than optimal performance during printing. Moreover, dirt, dust and other particulate matter may accumulate on the surface of the print head surrounding the ink ejection orifices and even inside the ink ejection orifices to thereby interfere with proper ejection and trajectory of ink drops from the ink ejection orifices. In addition, vibration and shock during transport of the printer may cause ink to weep, seep and otherwise leak out the ink ejection orifices. Therefore, in the prior art, a removable adhesive tape is temporarily adhered to the ink cartridge so as to cover the ink ejection orifices and surface area surrounding the ink ejection orifices. Presence of the tape blocks ingress of air and also dirt, dust and other particulate matter into the ink ejection orifices and blocks deposit of the dirt, dust and other particulate matter on the cartridge surface surrounding the ink ejection orifices. Presence of the tape also blocks ink weeping, seeping and otherwise leaking out the ink ejection orifices. Typically, this tape is applied to the cartridge by the manufacturer of the printer, and before the printer is shipped to a wholesaler, retailer, or end user, as the case may be. Of course, the tape must be removed by the end user before first use of the printer, so that ink drops can eject from the cartridges disposed in the printer. Instructional materials disclosing method of removal of the tape are typically included with the printer when the printer is received by the end user. Thus, removal of the tape requires the end user of the printer to read and understand the instructional materials included with the printer.

However, it has been observed that the end user often may not understand or even read the instructional materials prior to operating the printer with included ink cartridge. This is undesirable because operation of the printer with the tape still blocking the ink ejection orifices interferes with proper operation of the printer. The end user then erroneously assumes the printer is malfunctioning when in fact it is the end user's neglect to remove the protective tape from the cartridge that results in the printer's inability to print. Nonetheless, believing that the printer and/or ink cartridge is malfunctioning, the end user will contact the printer manufacturer and seek relief under the manufacturer's printer warranty. The printer manufacturer must then address the complaint made by the end user. Such complaints potentially increase customer dissatisfaction. Also, such complaints increase the manufacturer's cost of goods sold because the manufacturer of the printer then dedicates personnel resources, such as service technicians, to address the end user's complaint. Moreover, increase in the manufacturer's cost of goods sold may ultimately increase the market price of the printer. Of course, increase in the market price of the printer does not benefit the consumer. Therefore, a problem in the art is the requirement that the end user manually remove the protective tape from the ink cartridge when the printer, with included ink cartridge, are received by the end user.

An apparatus and method of at least notifying the end user that the protective tape is present, so that the end user may remove the tape, is disclosed by U.S. Pat. No. 6,260,942 titled "Sensor And Method For Detecting Protective Tape On A Printer Cartridge" issued Jul. 17, 2001 in the name of Adam Jude Ahne, et al. The Ahne et al. device comprises a printer cartridge having a protective tape to prevent ink leakage from the printer cartridge. According to one embodiment of the Ahne et al. device, the protective tape includes an electrically conductive metal strip. When the cartridge is present in the printer, the protective tape comes in contact with a printer carrier cable that serves as a printer-cartridge interface. The printer cable itself includes a sensor having a first electrical contact and a second electrical contact that are electrically shorted through the metal strip in the protective tape when the protective tape touches the contacts. This occurs because the metal strip in the protective tape bridges an electrical connection between the first and second contacts. A sensor circuit is associated with the sensor and is responsive to current flowing between the first and second contacts. The current occurs from the closed circuit created by presence of the metal strip of the protective tape. The sensor circuit detects the current and thus the presence of the protective tape on the cartridge. The sensor circuit includes an indicator responsive to the sensor circuit. The indicator provides a signal to the user of the printer through whatever printer display or controls are present. For example, the signal can be a visual signal as in an LCD display or can be an audible signal or other printer signal. Although the Ahne et al device informs the user of the presence of the protective tape, the user must still manually remove the protective tape before operating the printer. Manual removal of the protective tape represents an inconvenience to the user of the printer. Moreover, manufacturing cost of the printer, and thus price of the printer to the user, is substantially higher than it would otherwise be because the printer must now include a special protective tape with a metal strip, a sensor and sensor circuit, and a visual or audible indicator. Therefore, the device disclosed by the Ahne et al. patent does not satisfy the long-felt need to avoid requiring the end user to manually remove the protective tape from the ink cartridge when the printer, with included ink cartridge, are received by the end user.

Therefore, what is needed is an inkjet printer having ink cartridge tape removal capability and method of assembling the printer.

SUMMARY OF THE INVENTION

According to an aspect of the present invention, there is provided an inkjet printer having ink cartridge tape removal capability, comprising a slide bar; an ink cartridge slidably engaging the slide bar, the ink cartridge having an ink ejection orifice; and a take-up reel associated with the ink cartridge, the take-up reel having a tape extending therefrom and removably adhering to the ink ejection orifice, the tape peeling from the ink ejection orifice as the ink cartridge slidably engages the slide bar.

According to another aspect of the present invention, an inkjet printer having ink cartridge tape removal capability comprises a frame to which is affixed an elongate generally cylindrical slide bar. Slidably engaging the slide bar is a carriage operable to translate along the slide bar by means of a belt and pulley assembly. The belt and pulley assembly is operated by a motor controlled by a controller. The carriage carries a plurality of adjacent ink cartridges. Each of the ink cartridges has a plurality of ink ejection orifices capable of ejecting an ink drop therefrom for marking a recorder medium. A take-up reel comprising a spool is rotatably connected to the frame. The spool has adhesive protective tape extending therefrom. The tape removably adheres to the ink cartridges for sealably covering the ink ejection orifices. The tape peels from the ink cartridges to uncover the ink ejection orifices as the carriage carrying the ink cartridges slidably translates the first time along the slide bar in a direction away from the take-up reel.

An actuator is connected to the frame and engages the take-up reel for retracting the tape after the tape peels from the ink cartridges. The actuator rotates the take-up reel and therefore retracts the protective tape and winds the tape about the take-up reel to avoid the tape interfering with the carriage as the carriage reciprocatingly travels along the slide bar during printing. In this regard, a first embodiment actuator comprises a generally cylindrical shaft engaging the spool and a motor engaging the shaft for rotating the shaft. The spool rotates as the shaft rotates and the tape winds about the spool as the spool rotates. A second embodiment actuator comprises an axle engaging the spool and a pinion gear surrounding the axle. A rack, which is connected to the carriage, has a plurality of gear teeth thereon for engaging the pinion gear. The rack moves with the carriage as the carriage slides along the slide bar in a direction away from the take-up reel. As the rack moves with the carriage the teeth formed on the rack engage the pinion gear. The axle rotates as the gear teeth engage the pinion gear. In this manner, the spool rotates as the axle rotates. The protective tape winds about the spool as the spool rotates. A third embodiment actuator comprises a spindle engaging the spool and a coiled spring connected to the spindle for rotating the spindle. The spool rotates as the spindle rotates. The protective tape winds about the spool as the spool is rotated by the spring. A fourth embodiment actuator comprises an elastomer having one end portion connected to the take-up reel and another end portion integrally connected to the protective tape. The elastomer pulls on the tape and preferably wraps the tape about the take-up reel after the tape peels from the ink cartridges. The fourth embodiment actuator preferably further includes an optical sensor in optical communication with a reflective portion of the tape for sensing when the tape has been removed from the cartridges.

Thus, the act of sliding the carriage along the slide bar in a direction away from the take-up reel peels the adhesive tape from the ink cartridges in order to uncover the ink ejection orifices. After the ink ejection orifices are uncovered, the actuator operates the take-up reel to retract the protective tape and wrap the tape around the take-up reel. In this manner, the tape is not allowed to interfere with movement of the carriage during printing.

A feature of the present invention is the provision of a take-up reel for winding-up the protective tape after the tape peels from the cartridges.

Another feature of the present invention is the provision of an actuator engaging the take-up reel for actuating the take-up reel, so that the take-up reel winds-up the protective tape.

An advantage of the present invention is that the protective tape is removed from the ink cartridges to expose the ink ejection orifices without manual intervention of the user prior to first use of the printer.

These and other features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT

The present invention will be directed in particular to elements forming part of, or cooperating more directly with, apparatus in accordance with the present invention. It is to be understood that elements not specifically shown or described may take various forms well known to those skilled in the art.

Figure 1:
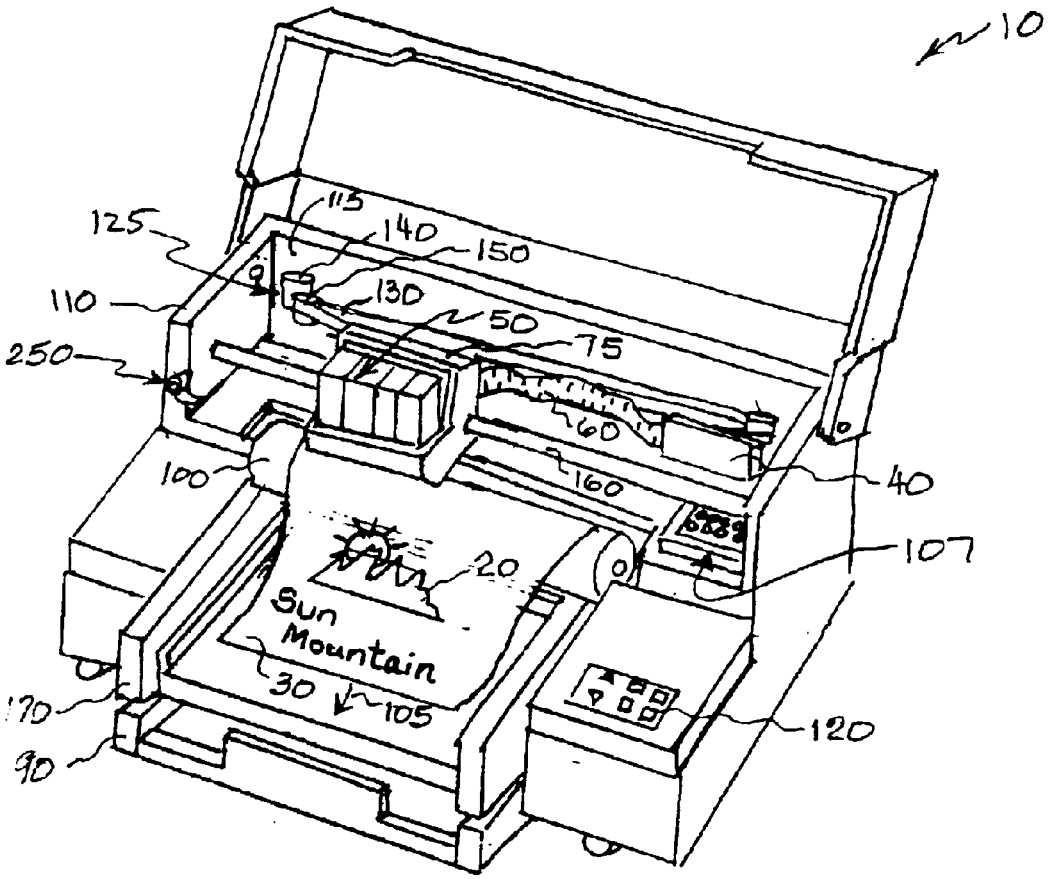
FIG. 1 is a view in perspective of an inkjet printer, this view showing a carriage carrying a plurality of adjacent ink cartridges printing an image on a recorder medium after a take-up reel has retracted protection tape from ink ejection orifices belonging to each of the ink cartridges.

Therefore, referring to FIG. 1, there is shown a thermal inkjet printer, generally referred to as 10, for printing an image 20 on a recorder medium 30. Recorder medium 30 may be paper or transparency or other material suitable for receiving image 20. An image input source (not shown), which may be a computer, scanner, facsimile machine, or an all-in-one combination of these devices, provides raster image data or other form of digital image data to printer 10.

Figure 2:
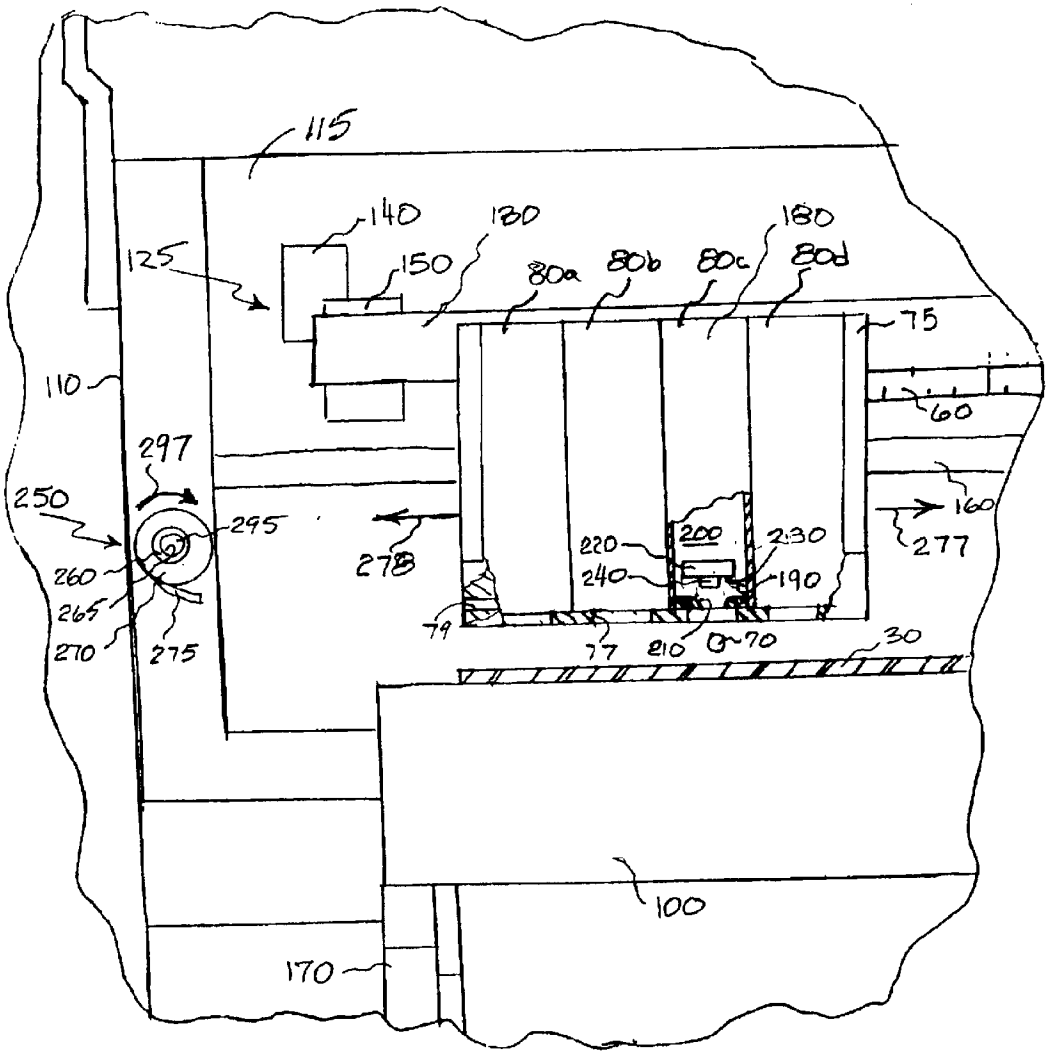
FIG. 2 is a view in partial elevation of the plurality of adjacent ink cartridges sliding along a slide bar and ejecting an ink drop from one of the ink ejection orifices, this view also showing the protection tape having peeled from the ink cartridges after the carriage has slidably translated along the slide bar, this view further showing the take-up reel retracting the tape after the tape peels from the ink cartridge.
Figure 3:
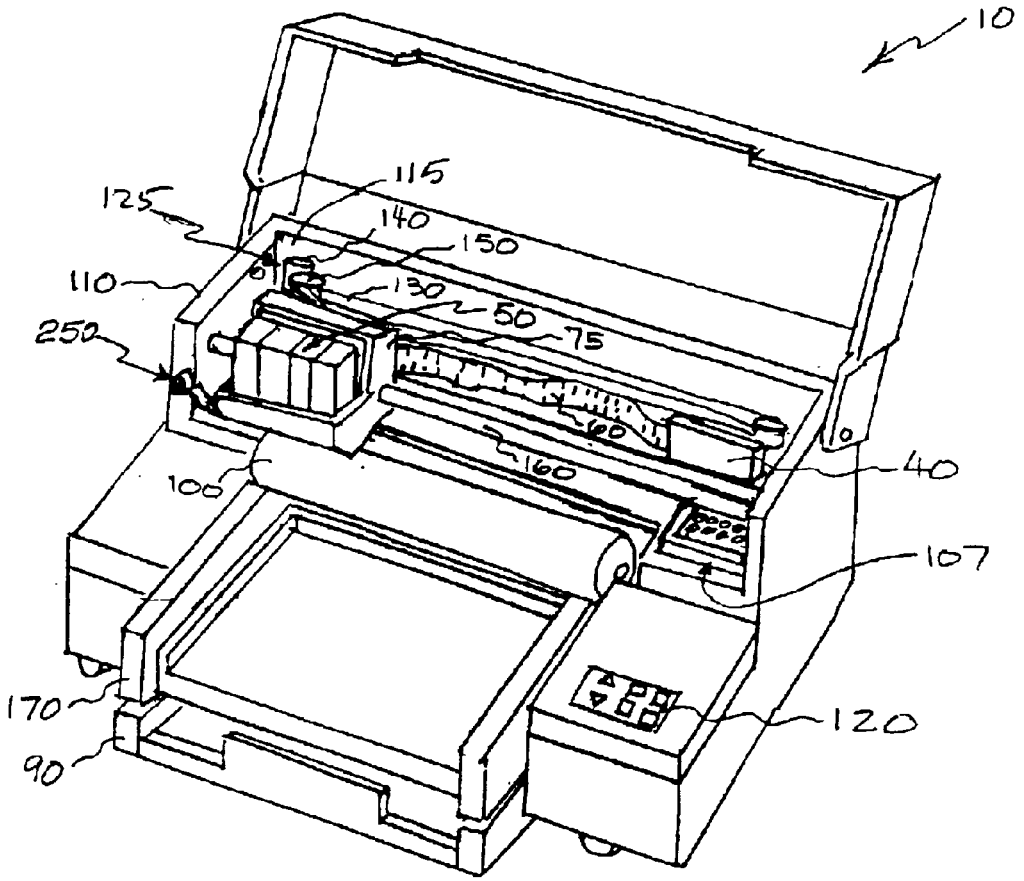
FIG. 3 is a view in perspective of the inkjet printer comprising a frame to which the take-up reel is attached.
Figure 4:
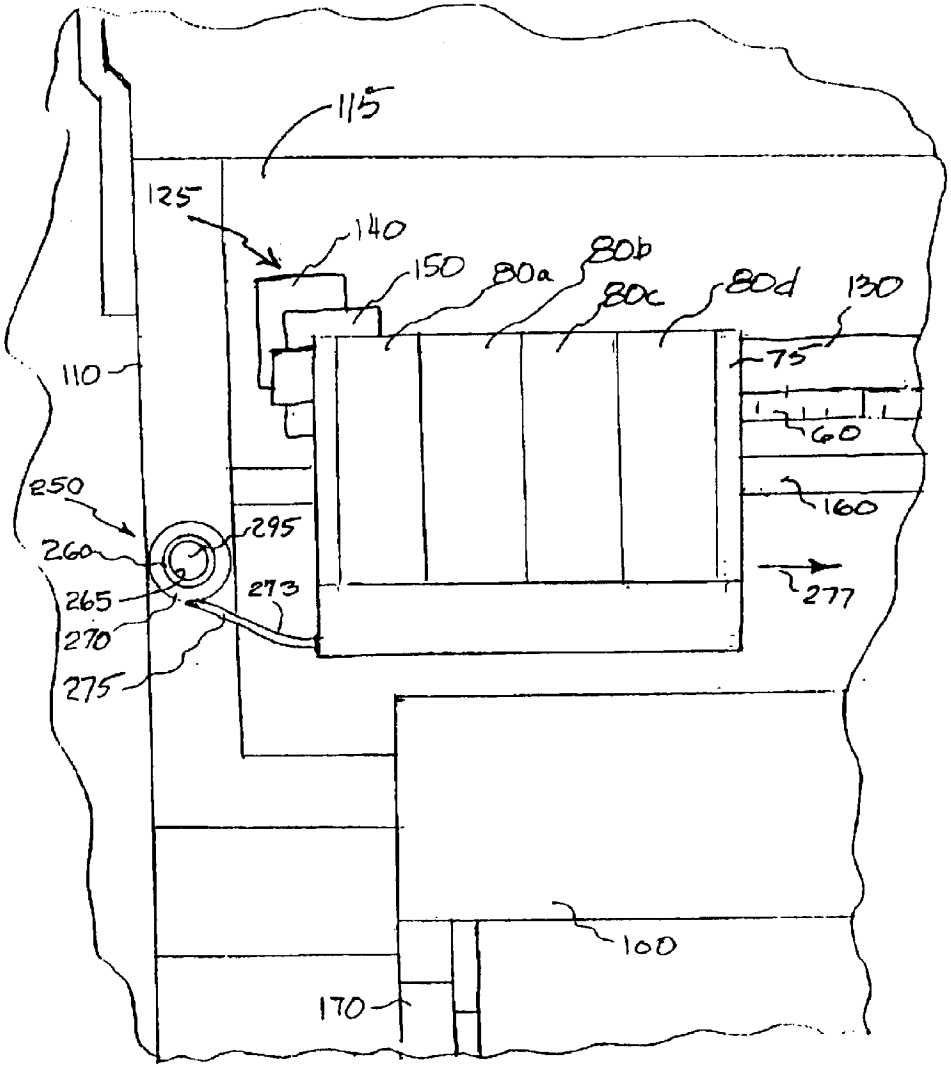
FIG. 4 is a view in elevation of the carriage carrying the plurality of adjacent ink cartridges, the carriage slidably engaging the slide bar, this view also showing the take-up reel having adhesive tape extending therefrom.
Figure 5:
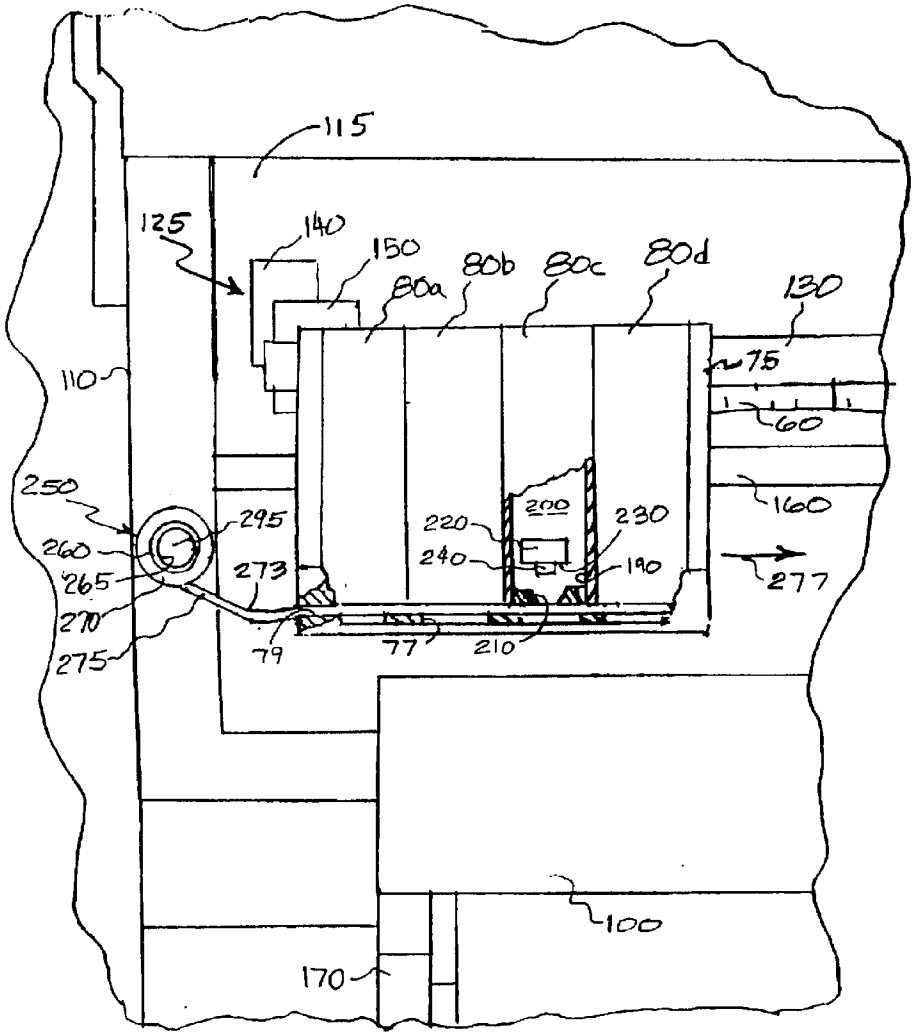
FIG. 5 is a view in partial elevation of the plurality of adjacent ink cartridges, this view also showing a thermal resistive heater element disposed adjacent one of the ejection orifices to eject the ink drop out the ink ejection orifice.
Figure 6:
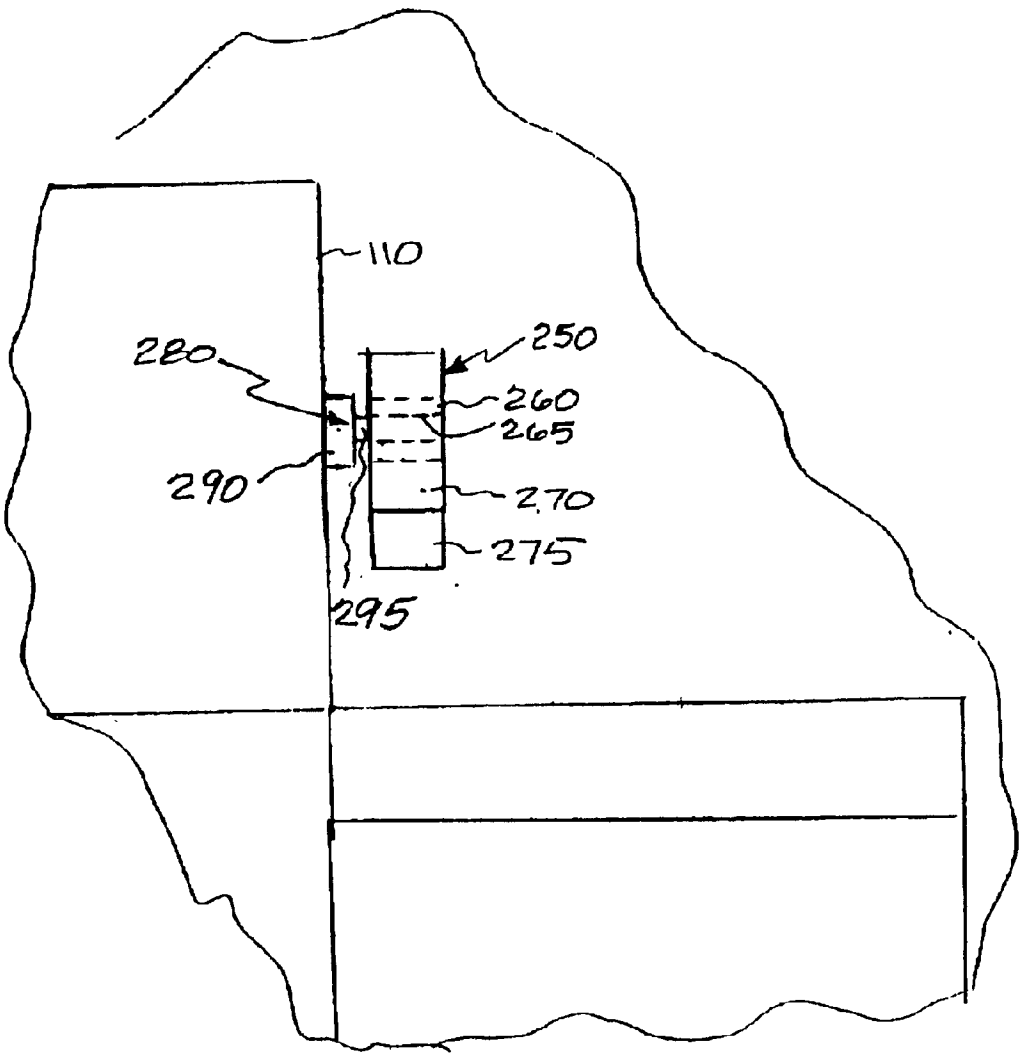
FIG. 6 is a view in elevation of a first embodiment actuator affixed to the frame and engaging the take-up reel for actuating the take-up reel so that the take-up reel retracts the tape.
Figure 7:
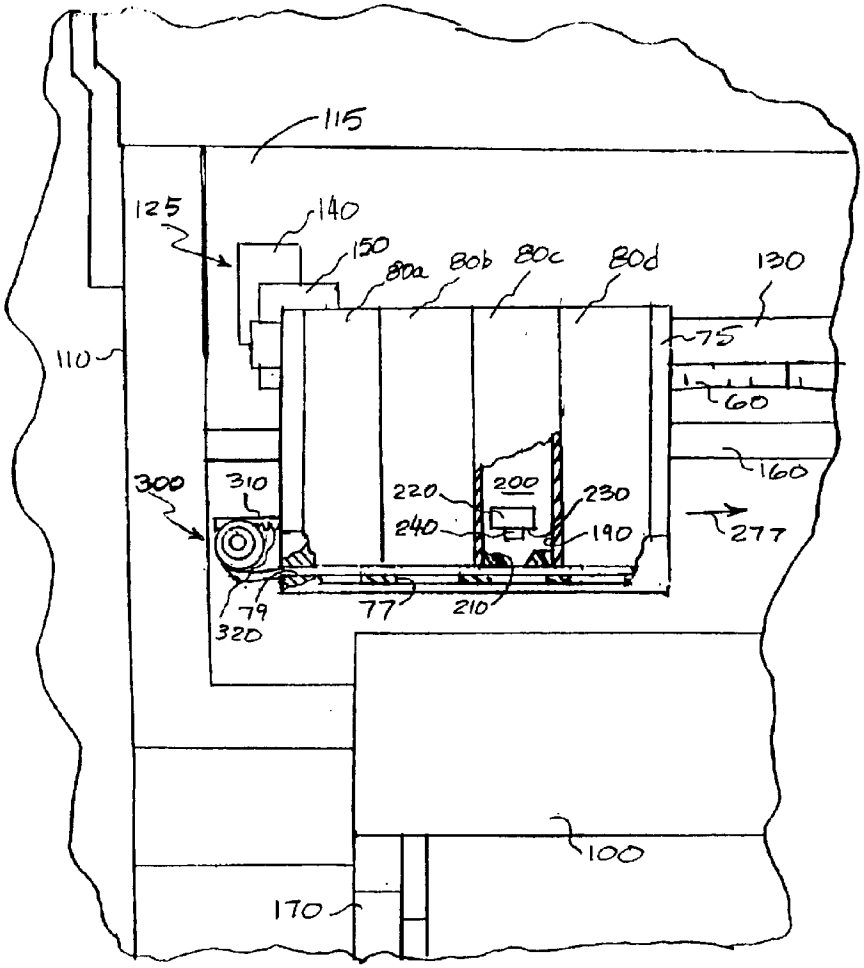
FIG. 7 is a view in elevation of a second embodiment actuator before retracting the tape.
Figure 8:
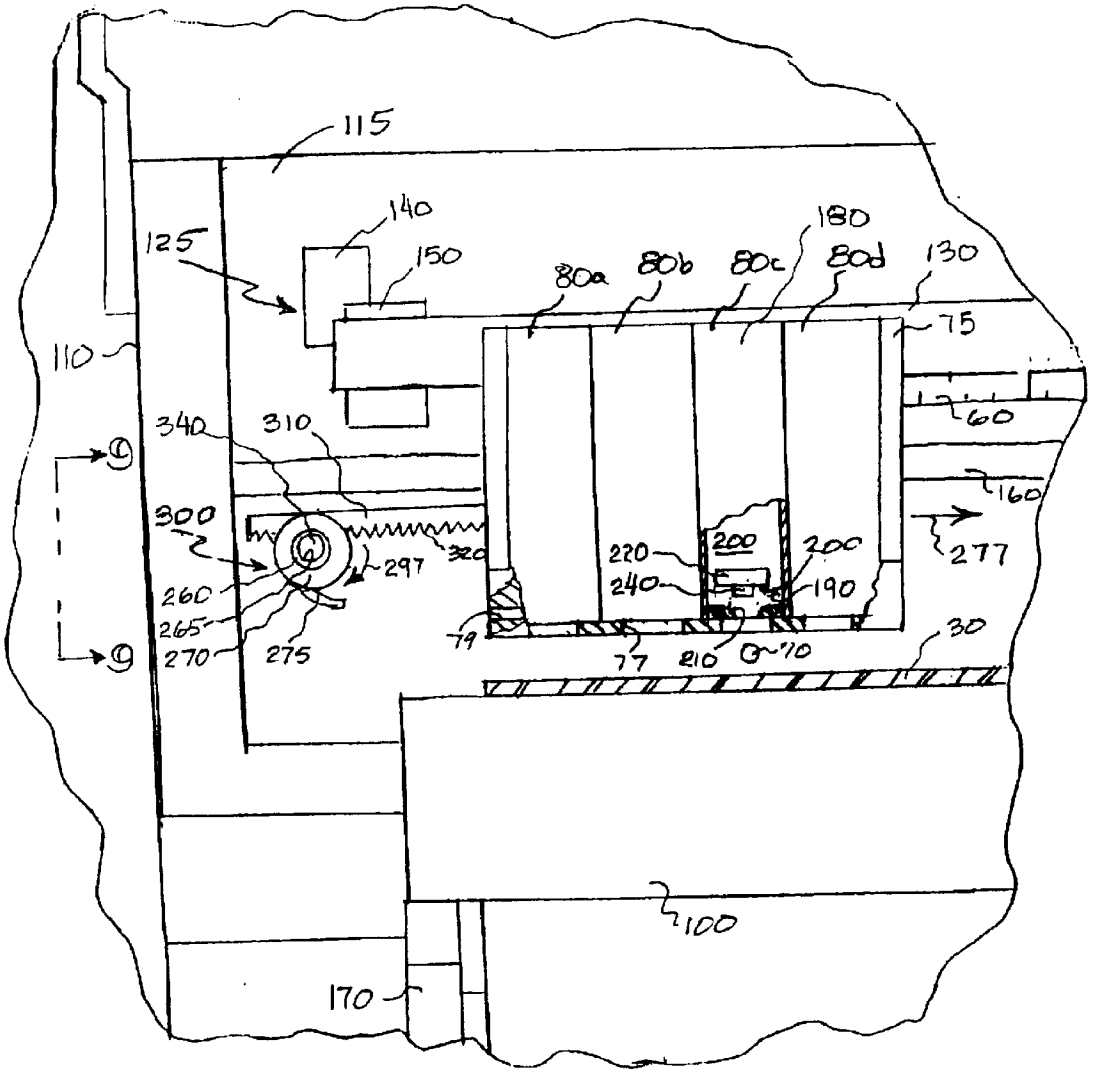
FIG. 8 is a view in elevation of the second embodiment actuator after retracting the tape.
Figure 9:
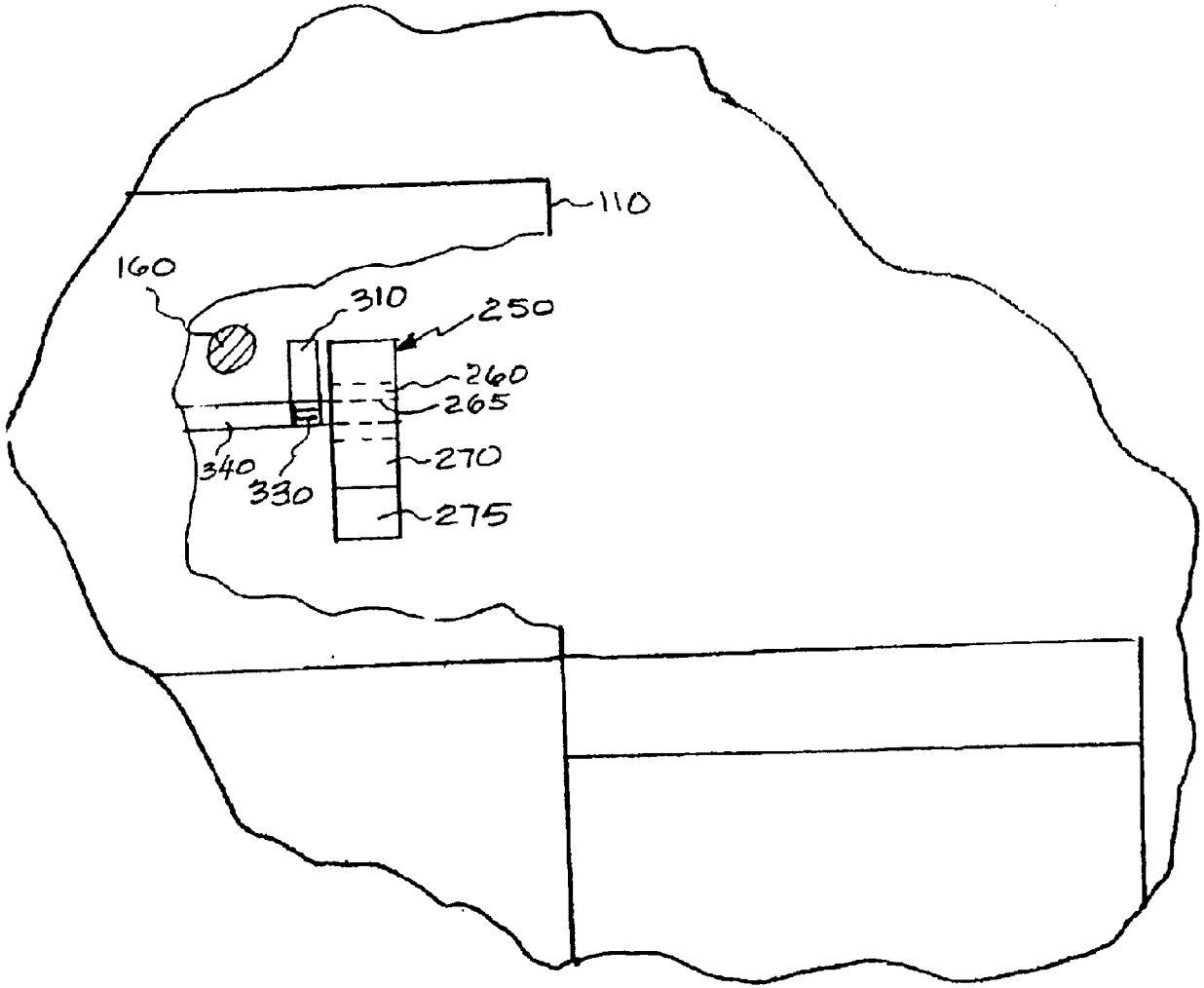
FIG. 9 is a view taken along section line 9—9 of FIG. 8.

Referring to FIGS. 1 and 2, the image input source generates an output signal that is received by a controller 40, which is coupled to the image input source. The controller 40 processes the output signal received from the image input source and generates a controller output signal that is received by a thermal ink jet print head, generally referred to as 50, electrically coupled to controller 40. Print head 50 is electrically coupled to controller 40, such as by means of an electrical cable 60. Controller 40 controls operation of print head 50 to eject an ink drop 70 therefrom in response to the output signal received from the image input source. Moreover, print head 50 comprises a carriage 75 carrying a plurality of adjacent print head ink cartridges 80*a*, 80*b*, 80*c*, and 80*d* containing differently colored inks, which may be magenta, yellow, cyan and black, respectfully, for forming a full-color version of image 20. Carriage 75 includes a plurality of holes 77 therethrough and a side opening 79 for reasons provided hereinbelow.

Referring again to FIGS. 1 and 2, individual sheets of recorder medium 30 are fed from a supply bin, such as a recorder medium sheet supply tray 90, by means of a picker mechanism (not shown). The picker mechanism picks the individual sheets of recorder medium 30 from tray 90 and feeds the individual sheets of recorder medium 30 onto a guide (also not shown) that is interposed between and aligned with print head 50 and the picker mechanism. The guide guides each sheet of recorder medium 30 into alignment with print head 50. Disposed opposite print head 50 is a rotatable platen roller 100 for supporting recorder medium 30 thereon and for transporting recorder medium 30 past print head 50. In this regard, platen roller 100 transports recorder medium 30 in direction of an arrow 105. As platen roller 100 transports recorder medium 30 past print head 50, ink cartridges 80*a*/*b*/*c*/*d* are selectively activated by controller 40 to print image 20 on recorder medium 30. Printer 10 also includes a print head maintenance station, generally referred to as 107, for periodically cleaning print head 50. The printer components mentioned hereinabove are housed in a printer shell or frame 110 that includes a rear wall 115. Frame 110 also includes an integrally connected control panel 120 electrically connected to controller 40 for controlling printer operational characteristics, such as paper size and whether the printer is turned "on" or "off".

Referring yet again to FIGS. 1 and 2, during printing, print head 50 is driven transversely with respect to recorder medium 30 preferably by means of a motorized continuous belt and pulley assembly, generally referred to as 125. The belt and pulley assembly comprises a continuous belt 130 affixed to carriage 75 and a belt motor 140 engaging belt 130. Motor 140 engages belt 130 by means of at least one pulley 150 and is preferably electrically connected to controller 40, so that controller 40 controls operation of motor 140. As motor 140 rotates pulley 150, belt 130 also rotates. As belt 130 rotates, carriage 75 traverses recorder medium 30 because carriage 75 is affixed to belt 130, which extends traversely across recorder medium 30. Moreover, carriage 75 is itself supported by an elongate, generally cylindrical slide bar 160 that slidably engages and supports carriage 75 as carriage 75 traverses recorder medium 30. Slide bar 130 in turn is supported by frame 110 because opposing ends of slide bar 160 are each affixed to frame 110. Of course, controller 40 may be coupled to the previously mentioned picker mechanism, platen roller 100, and motor 140, as well as cartridges 80*a/b/c/d*. Controller 40 is coupled to the picker mechanism, platen roller 100, and the motor 140, as well as cartridges 80*a/b/c/d* for synchronously controlling operation of the picker mechanism, platen roller 100, motor 140, and for selectively activating cartridges 80*a/b/c/d*. Each time carriage 75 traverses recorder medium 30, selected ones of cartridges 80*a/b/c/d* print a swath of image information onto recorder medium 30. After each swath of image information is printed onto recorder medium 30, platen roller 100 is rotated in order to increment recorder medium 30 a predetermined distance in the direction of arrow 105. After recorder medium 30 is incremented the predetermined distance, carriage 75 is again caused to traverse recorder medium 30 to print another swath of image information. Image 20 is formed after all desired swaths of printed information are printed on recorder medium 30. After image 20 is printed on recorder medium 30, the recorder medium 30 exits printer 10 to be deposited in an output bin 170 for retrieval by a user of printer 10.

As best seen in FIG. 2, print head 50 comprises the previously mentioned side-by-side ink cartridges 80*a/b/c/d*. Each of cartridges 80*a/b/c/d* comprises a cartridge body 180 defining a chamber 190 therein. For reasons disclosed more fully hereinbelow, chamber 190 is capable of receiving an ink body 200 from which image 20 will be formed. Formed in cartridge body 180 is at least one ink ejection orifice 210 in communication with chamber 190 and collinearly aligned with a respective one of holes 77 formed through carriage 75.

Referring again to FIG. 2, horizontally-disposed in chamber 180 is a generally rectangular die 220. Die 220 has an underside surface 230 for reasons disclosed presently. In this regard, attached to underside 230 of die 220 and therefore disposed in chamber 190 is at least one thermal resistive heater element or thin-film resistor 240 aligned with ink ejection orifice 210. Resistor 240 locally boils ink body 200 in the vicinity of orifice 210. Resistor 240 is electrically connected to controller 40, so that controller 40 controls flow of electrical energy to resistor 240 in response to output signals received from the previously mentioned image input source. In this regard, when electrical energy momentarily flows to resistor 240, the resistor 240 locally heats ink body 200 causing a vapor bubble (not shown) to form adjacent to resistor 240. The vapor bubble pressurizes chamber 190 by displacing ink body 200 in order to squeeze ink drop 70 from ink body 200. Ink drop 70 travels through orifice 210 and hole 77 to be intercepted by recorder medium 30. After a predetermined time, controller 40 ceases supplying electrical energy to resistor 240. The vapor bubble will thereafter collapse due to absence of energy input to ink body 200 and ink from ink body 200 will subsequently refill chamber 190.

As previously mentioned, the manufacturer of printer 10 may ship the printer to the printer wholesaler, printer retailer or end user with cartridges 80*a/b/c/d* preinstalled in printer 10. This is done for the convenience of the user of printer 10. That is, by receiving printer 10 with cartridges 80*a/b/c/d* preinstalled, the user need not separately purchase and install cartridges 80*a/b/c/d* before beginning operation of printer 10. However, it is important during transport and storage of printer 10 to temporarily seal ink ejection orifices 210 against ingress of dirt, dust and other particulate matter. It is also important to seal ink ejection orifices 210 against ingress of air to avoid drying-out of the ink. Moreover, it is important to prevent leakage of the ink from ink ejection orifices 210 which might otherwise occur due to vibration and shock during transport of printer 10. Therefore, the printer manufacturer may place a removable adhesive protective tape, as described more fully hereinbelow, that adheres to ink cartridges 80*a/b/c/d* so as to cover ink ejection orifices 210 and the surface area surrounding the ink ejection orifices 210. Of course, it is highly desirable to remove the protective tape immediately before first use of printer 10, so that ink drops 70 can be ejected from cartridges 80*a/b/c/d*. However, the user may neglect to remove the protective tape before trying to print the first time. As described in detail hereinbelow, printer 10 is capable of automatically removing the protective tape immediately before printer 10 is first used, such that the user need not manually remove the tape.

Therefore, turning now to FIGS. 3, 4, 5 and 6, printer 10 is there shown immediately prior to first use. A take-up reel, generally referred to as 250, is connected to frame 110 for reasons disclosed presently. In this regard, take-up reel 250 comprises a generally cylindrical spool 260 having a centrally disposed bore 265 therethrough. Wound about spool 260 is a ribbon of adhesive protective tape 270 having an adhesive side 273 and an outwardly extending portion 275. Portion 275 extends through side opening 79 of carriage 75 and removably adheres to cartridges 80*a/b/c/d* for sealably covering orifices 210. Although portion 275 is illustrated as extending through side opening 79, portion 275 may instead extend through a bottom opening, a front opening, or a back opening (all not shown) of carriage 75. Of course, in this instance, carriage 75 would be fabricated to include a bottom opening, front opening, or back opening to accommodate portion 275. Protective tape 270 may be any suitable protective tape. For example, protective tape 270 may be "V8HP"™ tape available from Nitto Denko Europe, NV located in Genk, Belgium. As another example, protective tape 270 may be "ELVAX 3190LG"™ tape available from E.I. DuPont de Nemours and Company located in Wilmington, Del., U.S.A.

Referring again to FIGS. 3, 4, 5 and 6, carriage 75 will translate along slide bar 160 in direction of arrow 277 upon first use of printer 10. When carriage 75 translates in direction of arrow 277, protective tape 270 will peel from cartridges 80*a/b/c/d* to expose ink ejection orifices 210. A first embodiment actuator, generally referred to as 280, is connected to frame 110 and engages take-up reel 250 for retracting protective tape 270 after tape 270 is peeled from cartridges 80*a/b/c/d*. In this regard, actuator 280 comprises a motor 290 having a generally cylindrical shaft 295 for matingly engaging bore 265 formed through spool 260. Shaft 295 rotates, such as in direction of arrow 297 (see FIG. 2). With reference to FIGS. 3, 4, 5 and 6, spool 260 rotates as shaft 295 rotates. Protective tape 270 will be pulled through side opening 79 and wound about spool 260 as spool 260 rotates. To achieve this result, motor 290 is electrically connected to controller 40, which is in turn programmed to operate motor 290 when carriage 75 moves the first time during printing, which will occur after printer 10 is shipped from the printer manufacturer. Controller 40 is programmed to thereafter not operate motor 290 because motor 290 is only needed to wind protective tape 270 about spool 260 when protective tape 270 is removed from cartridges 80*a*/*b*/*c*/*d*. Protective tape 270 is removed from cartridges 80*a*/*b*/*c*/*d* only when the user operates printer 10 the first time. Therefore, motor 290 only need operate once.

Still referring to FIGS. 3, 4, 5 and 6, it may be appreciated that motor 290 may be selected such that motor 290 has enough power to remove protective tape 270 from cartridges 80*a*/*b*/*c*/*d* without translation of carriage 75 along slide bar 160. In other words, motor 290 may be selected to exert enough torque on shaft 295, and therefore spool 260, to overcome the peel force of protective tape 270 even while carriage 75 remains stationary.

Referring to FIGS. 7, 8, 9 and 10, there is shown a second embodiment actuator, generally referred to 300, connected to frame 110 and engaging take-up reel 250 for retracting protective tape 270 after tape 270 is peeled from cartridges 80*a*/*b*/*c*/*d* by translation of carriage 75 in direction of arrow 277. An advantage of this second embodiment actuator 300 is that it obviates need for motor 290. The second embodiment actuator 300 also obviates need for programming controller 40 to operate motor 290 only one time. Second embodiment actuator 300 comprises a rack 310 connected to carriage 75. Rack 310 includes a plurality of gear teeth 320 therealong for threadably engaging a pinion gear 330 surrounding an axle 340. The axle 340 has an end thereof rotatably connected to rear wall 115 and another end matingly engaging bore 265 of spool 260. Thus, it may be understood from the description hereinabove that rack 310 moves in direction of arrow 277 as carriage 75 translates in direction of arrow 277 because rack 310 is connected to carriage 75. As rack 310 moves in direction of arrow 277, gear teeth 320 will engage pinion gear 330. Axle 340 will rotate, such as in direction of arrow 297, as gear teeth 320 engage pinion gear 330. As axle 340 rotates, spool 260 will rotate in direction of arrow 297 in order to retract tape 270. It may be appreciated from the description hereinabove that movement of carriage 75 in direction of arrow 277 peels tape 270 from cartridges 80*a*/*b*/*c*/*d* so as to uncover orifices 210. Thereafter, rack 310 and pinion gear 330 cooperate to wind tape 270 about spool 260 after tape 270 peels from cartridges 80*a*/*b*/*c*/*d*.

Figure 10:
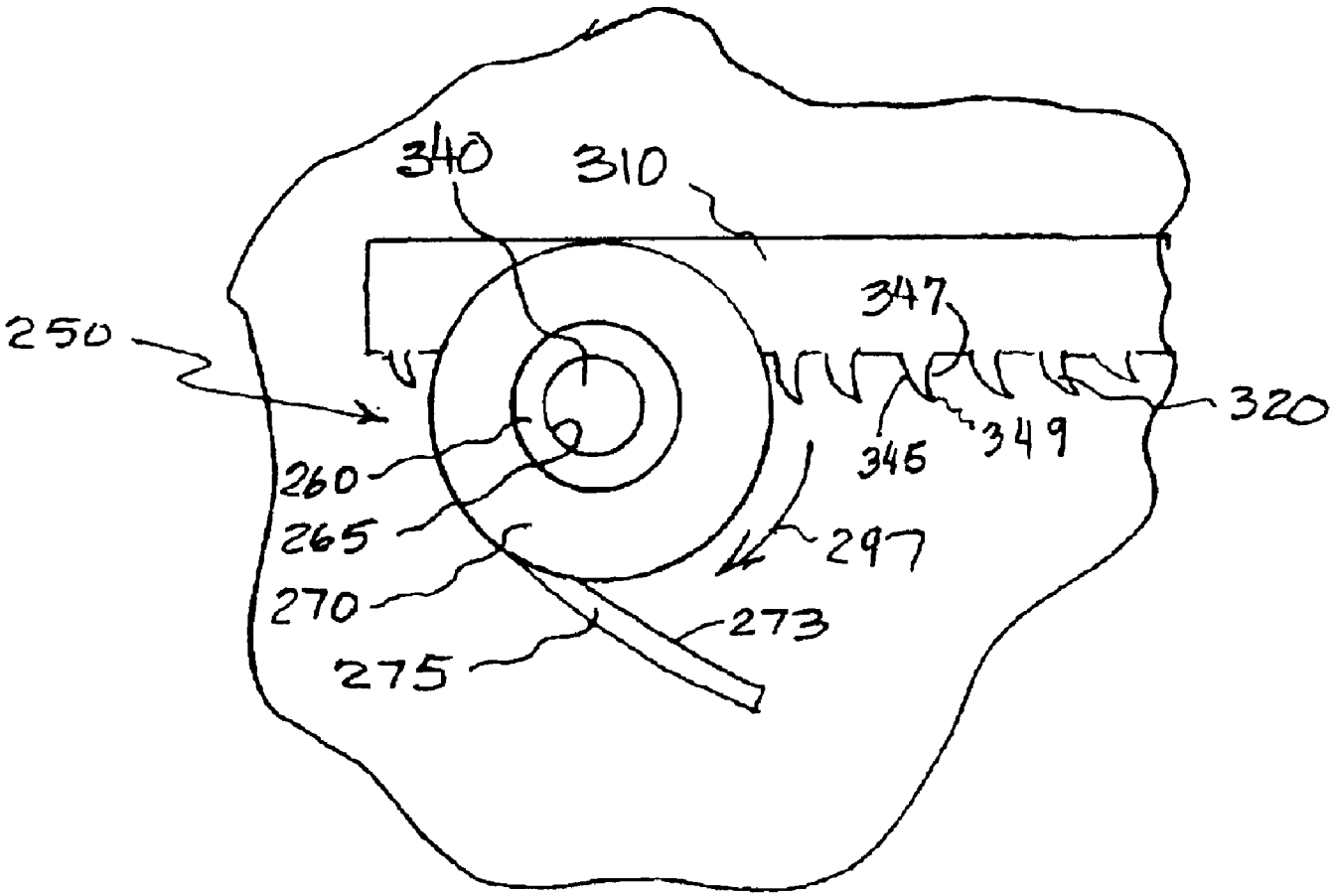
FIG. 10 is a fragmentary view in elevation of the second embodiment actuator after retracting the tape.

As best seen in FIG. 10, teeth 320 may be formed so as to present a convex first surface 345 to pinion gear 320. Teeth 320 are also formed so as to have a concave second surface 347 opposite first surface 345. Convex first surface 345 and concave second surface 347 terminate in a ridge or edge 349. For the reasons that follow, it is important that each tooth 320 has convex first surface 345, concave second surface 347 and edge 349. In this regard, as carriage 75 translates in direction of arrow 277, edge 349 will engage pinion gear 300 to turn pinion gear 330 so that spool 260 rotates in direction of arrow 297. As spool 260 rotates, tape 270 will wind about spool 260, so that there is no subsequent interference of tape 270 with carriage 75 during operation of printer 10. However, to insure tape 270 does not unwind from spool 260 when carriage 75 travels in a direction opposite arrow 277, convex first surface 345 will merely slide-over and not engage pinion gear 330. Therefore, pinion gear 330 will not rotate in a direction opposite arrow 297.

Figure 11:
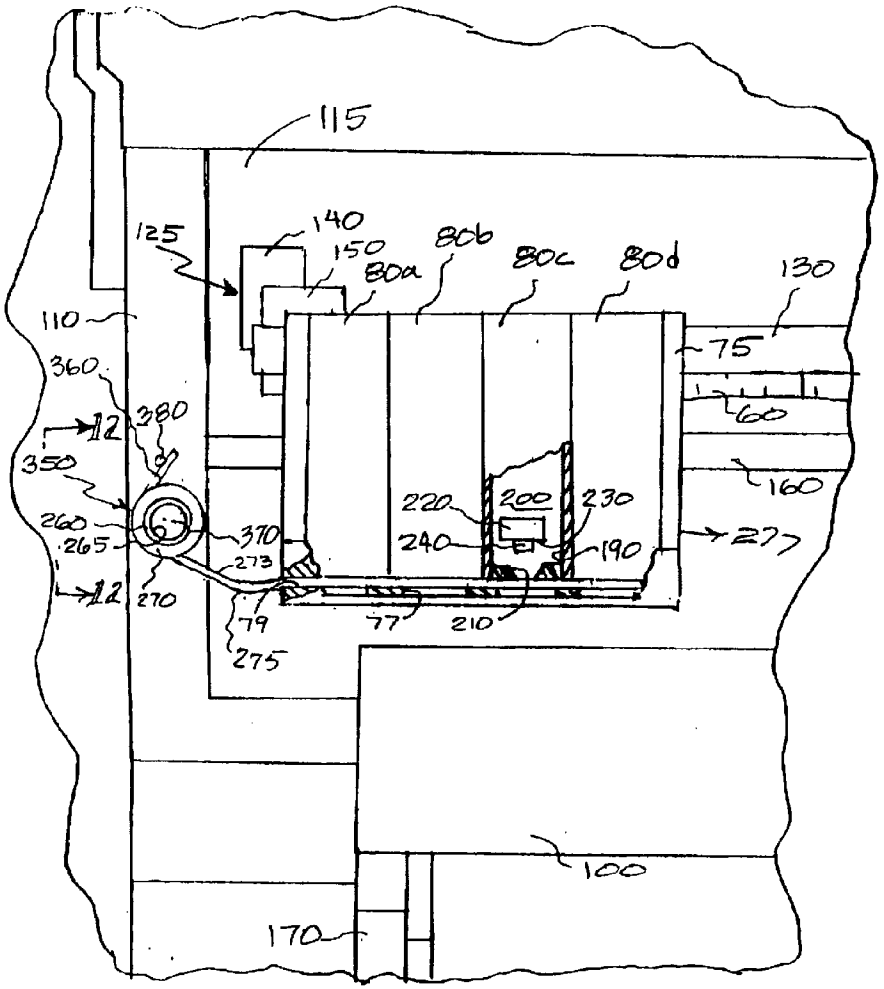
FIG. 11 is a view in elevation of a third embodiment actuator.
Figure 12:
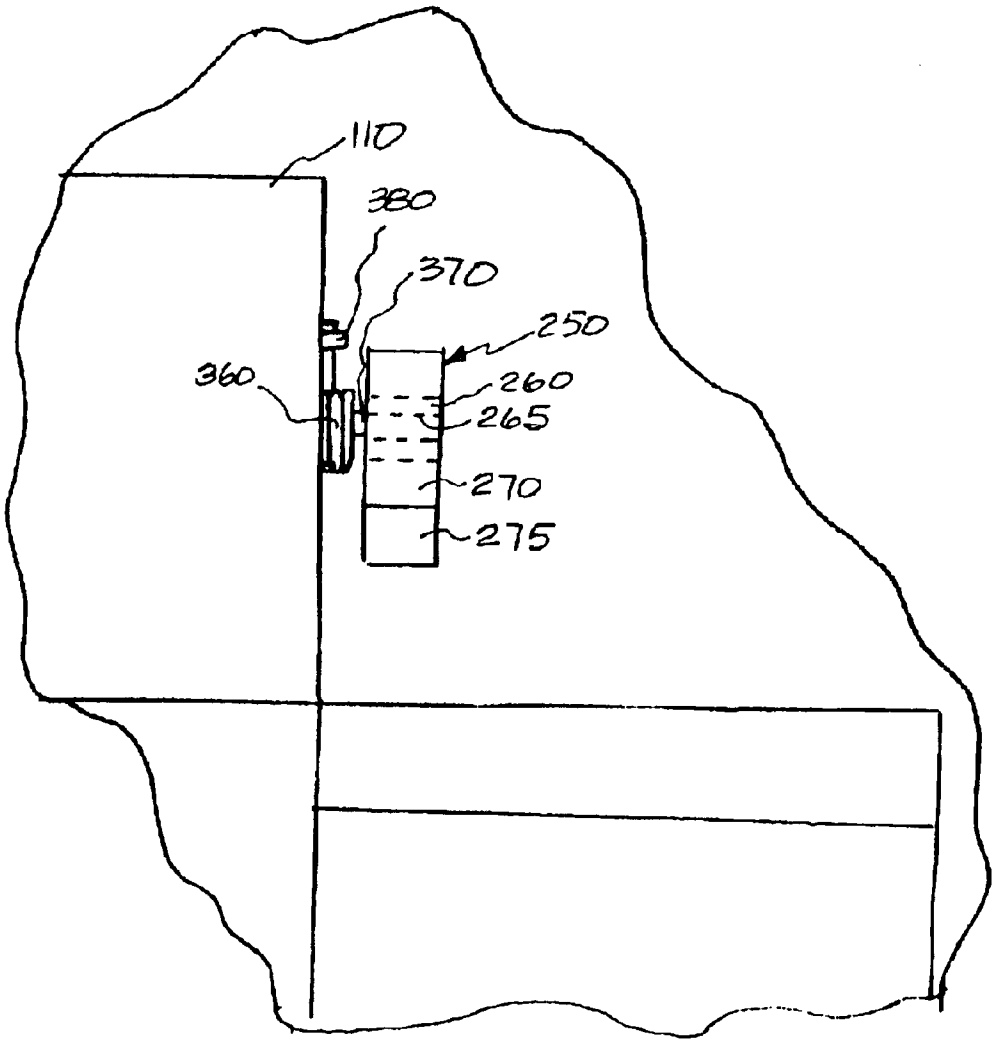
FIG. 12 is a view in elevation of the third embodiment actuator taken along section line 12—12 of FIG. 11.

Referring to FIGS. 11 and 12, there is shown a third embodiment actuator, generally referred to as 350, connected to frame 110 and engaging take-up reel 250 for retracting protective tape 270 after tape 270 is peeled from cartridges 80*a*/*b*/*c*/*d* by translation of carriage 75 in direction of arrow 277. An advantage of this third embodiment actuator 350 is that it obviates need for motor 290 that belongs to the first embodiment actuator 280. This third embodiment actuator also obviates need for rack 310 and pinion gear 330 belonging to the second embodiment actuator 300. Rather, this third embodiment actuator 350 relies on a biasing member, such as coiled spring 360, for rotating spool 260. In this regard, spring 360 has a portion thereof affixed to a spindle 370 rotatably connected to frame 110. Another end of spring 360 abuts an outwardly projecting post 380 that is attached to frame 110. As carriage 75 translates in direction of arrow 277, protective tape 270 is peeled from cartridges 80*a*/*b*/*c*/*d* to uncover orifices 210. It may be appreciated that while protective tape 270 adheres to cartridges 80*a*/*b*/*c*/*d*, the peel force is greater than the torque acting on spool 260 due to the predetermined relatively weak spring constant of spring 360. Thus, spool 260 cannot rotate while tape 270 adheres to cartridges 80*a*/*b*/*c*/*d*. However, after tape 270 peels from cartridges 80*a*/*b*/*c*/*d*, the peel force of tape 270 becomes zero. Thereafter, torque acting on spool 260 is greater that the peel force because the peel force is zero (i.e., tape 270 has peeled from cartridges 80*a*/*b*/*c*/*d*). Thus, spool 260 will rotate due to torque applied to spool 260 by spring 360. Of course, tape 270 will wind about spool 260 as spool 260 rotates.

Figure 13:
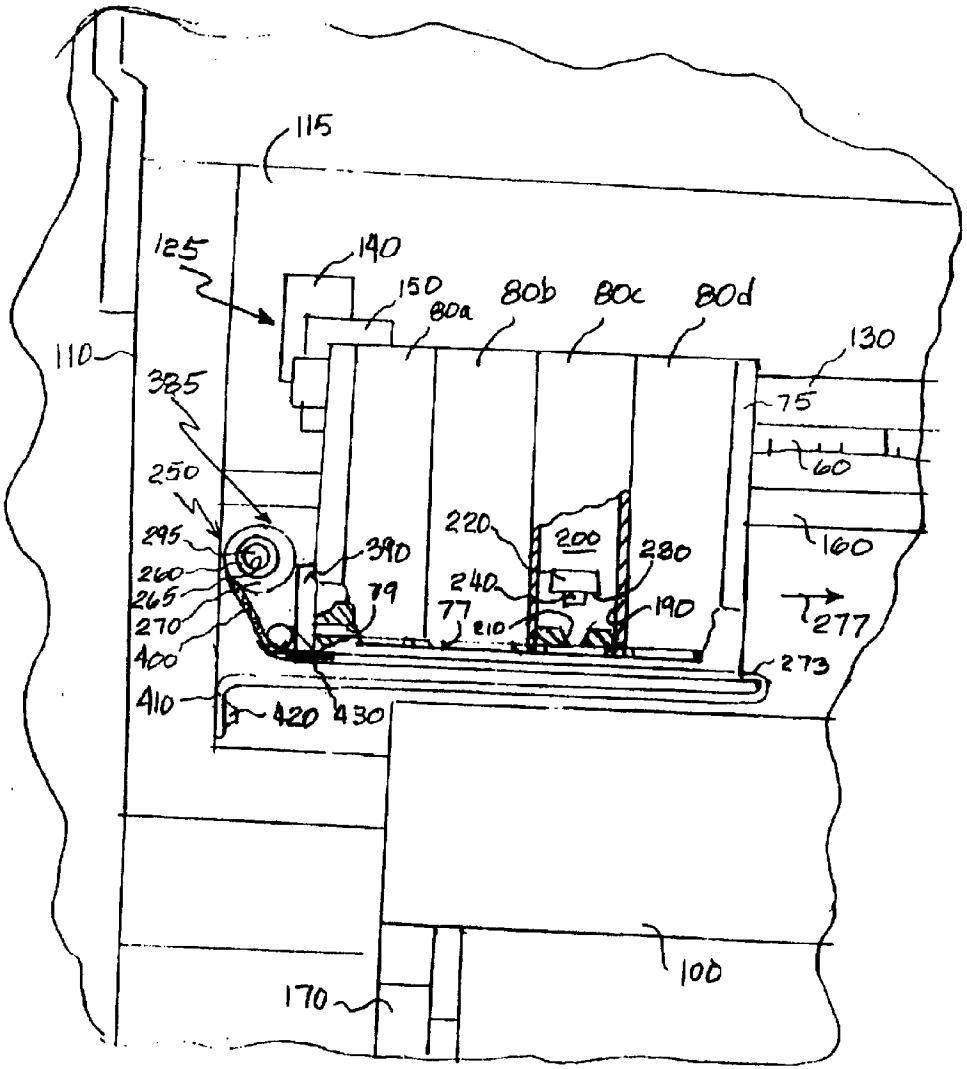
FIG. 13 is a view in elevation of a fourth embodiment actuator before the tape being peeled, the tape being arranged into a U-shaped configuration.
Figure 14:
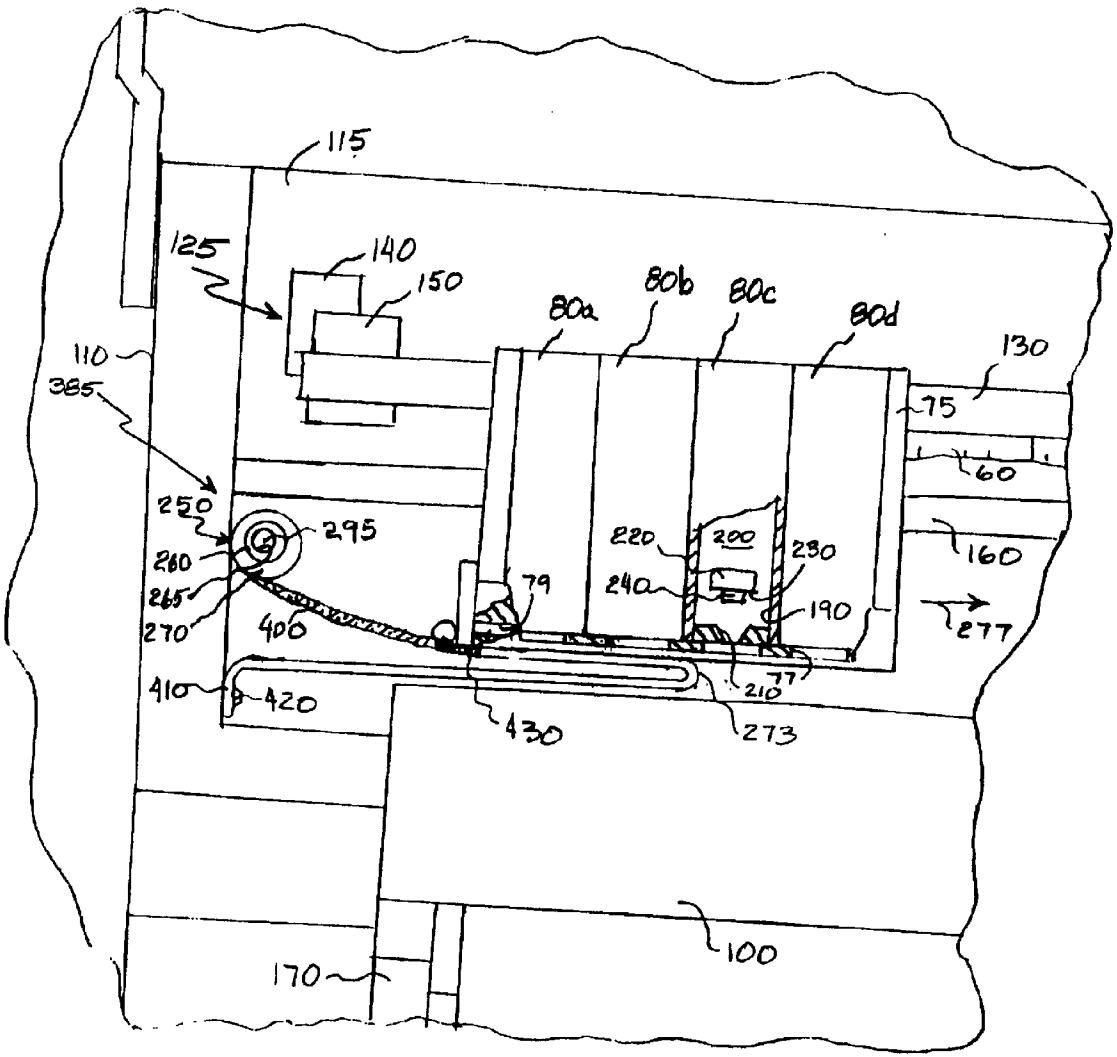
FIG. 14 is a view in elevation of the fourth embodiment actuator as the tape is being peeled.
Figure 15:
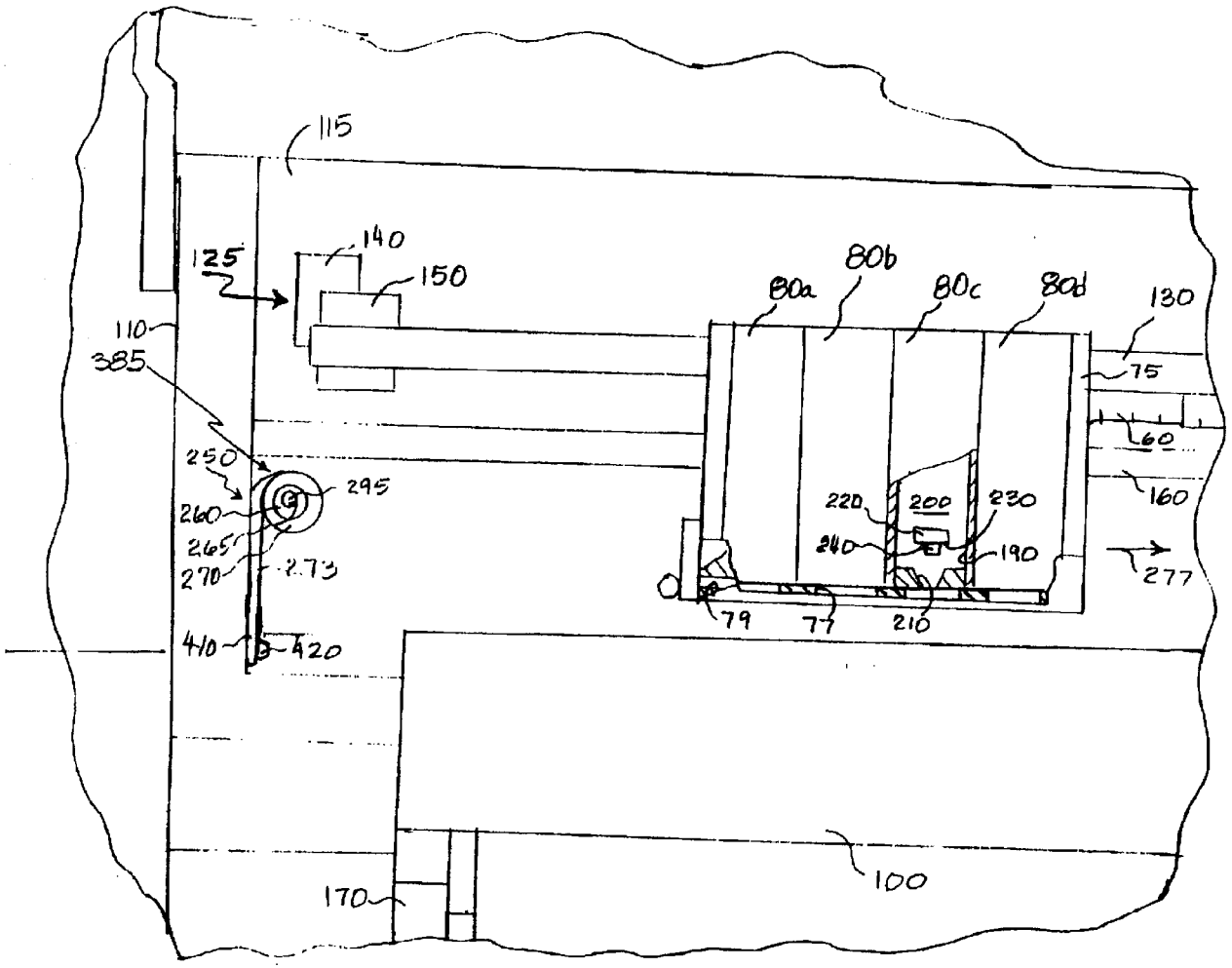
FIG. 15 is a view in elevation of the fourth embodiment actuator after the tape is retracted.

Referring now to FIGS. 13, 14 and 15, there is shown a fourth embodiment actuator 385 in combination with an optical sensor 390 for retracting protective tape 270 and for sensing when protective tape 270 is retracted. In this regard, optical sensor 390 emits an optical beam therefrom in direction of protective tape 270 when printer 10 is connected to a suitable power supply (not shown). Protective tape 270 defines a generally U-shaped configuration and has an elastomer or elastic portion 400 connected to spool 260 and an end portion 410 anchored to an inner wall of frame 110, such as by means of a fastener or clamp 420. The previously mentioned adhesive side 273 of protective tape 270 adhesively adheres to an underside of carriage 75 for sealably covering holes 77 in carnage 75. Sealably covering holes 77 in turn seals ink ejection orifices 210 because holes 77 are disposed adjacent to and opposite orifices 210. Integrally formed with protective tape 270 is an opaque or reflective tape tab 430 for reasons disclosed hereinbelow. Before printer 10 is used the first time, adhesive side 273 covers holes 77.

Still referring to FIGS. 13, 14 and 15, before printer 10 is used the first time, reflective tape tab 430 obstructs the previously mentioned optical beam emitted by optical sensor 390 and reflects the light beam back to optical sensor 390. Moreover, elastic portion 400 is in an extended state and exerts a retractive pull force on protective tape 270. However, the pull force exerted by elastic portion 400 is insufficient to overcome the lap shear force of the adhesive present on adhesive side 273 of protective tap 270. Therefore, protective tape 270 will not shear from carriage 75 before printer 10 is used the first time by the end user. In any event, when the reflected light beam is received by optical sensor 390, the optical sensor 390 transmits an electrical signal to control panel 120 to visually inform the end user that protective tape 270 is presently covering holes 77 and orifices 210. Alternatively, optical sensor 390 may transmit an electrical signal to an enunciator (not shown) to audibly inform the end user that protective tape 270 covers holes 77 and orifices 210. However, when printer 10 is used the first time for priming by the end user, carriage 75 will move in direction of arrow 277 and adhesive side 273 will begin peeling from the underside surface of carriage 75 in order to begin uncovering holes 77 and thus orifices 210. After holes 77 and orifices 210 of all ink cartridges are uncovered, elastic portion 400 of tape 270 fully contracts and the pull force of the contracting elastic portion 400 will wind protective tape 270 about spool 260. End portion 410 of protective tape 270 remains anchored to fastener 420 as protective tape 270 winds about spool 260. In this manner, protective tape 270 is positioned against the inner wall of frame 110 so that protective tape 270 avoids interference with movement of carriage 75 during printing. Moreover, after holes 77 and orifices 210 of all ink cartridges are uncovered, reflective tape tab 430 no longer obstructs the light beam emitted by optical sensor 390. At this point, optical sensor 390 will preferably inform control panel 12 (or an enunciator) that protective tape 270 no longer covers holes 77 and orifices 210.

It may be appreciated from the description hereinabove, that an advantage of the present invention is that the protective tape is removed from the ink cartridges to expose the ink ejection orifices without manual intervention of the user prior to first use of the printer. As mentioned hereinabove, this reduces customer dissatisfaction and reduces customer complaints. Reduction in customer complaints reduces the manufacturer's cost of goods sold because the manufacturer of the printer need not dedicate personnel resources, such as service technicians, to address customer complaints. Moreover, decrease in the manufacturer's cost of goods sold may ultimately decrease the market price of the printer. Of course, decreasing the market price of the printer benefits customers.

While the invention has been described with particular reference to its preferred embodiments, it will be understood by those skilled in the art that various changes may be made and equivalents may be substituted for elements of the preferred embodiments without departing from the invention. For example, inkjet printer 10 need not be a thermal inkjet printer. That is, inkjet printer 10 may be a piezoelectric inkjet printer having piezoelectric inkjet cartridges. As another example, although the description hereinabove is directed to inkjet printers having the print head and ink cartridges combined as one installable unit, the inventive concept disclosed herein will work equally well with printers having separately mounted ink supply and print head.

Therefore, what is provided is an inkjet printer having ink cartridge tape removal capability and method of assembling the printer.

PARTS LIST

10 . . . inkjet printer
20 . . . image
30 . . . recorder medium
40 . . . controller
50 . . . print head
60 . . . electrical cable
70 . . . ink drop
75 . . . carriage
77 . . . holes
79 . . . side opening
80*a/b/c/d* . . . ink cartridges
90 . . . recorder medium sheet supply bin
100 . . . platen roller
105 . . . arrow (direction of travel for recorder medium)
107 . . . maintenance station
110 . . . printer frame
115 . . . rear wall (of frame)
120 . . . control panel
125 . . . belt and pulley assembly
130 . . . belt
140 . . . belt motor
150 . . . pulley
160 . . . slide bar
170 . . . output bin
180 . . . cartridge body
190 . . . chamber
200 . . . ink body
210 . . . ink ejection orifice
220 . . . die
230 . . . underside (of die)
240 . . . thermal resistor
250 . . . take-up reel
260 . . . spool
265 . . . bore
270 . . . protective tape
273 . . . adhesive side (of protective tape)
275 . . . portion (of protective tape)
277 . . . arrow (first direction of travel of carriage)
278 . . . arrow (second direction of travel of carriage)
280 . . . first embodiment actuator
290 . . . motor
295 . . . shaft
297 . . . arrow (direction of rotation of spool)
300 . . . second embodiment actuator
310 . . . rack
320 . . . gear teeth
330 . . . pinion gear
340 . . . axle
345 . . . first surface of gear teeth
347 . . . second surface of gear teeth
349 . . . edge
350 . . . third embodiment actuator
360 . . . spring
370 . . . spindle
380 . . . post
385 . . . fourth embodiment actuator
390 . . . optical sensor
400 . . . elastomer or elastic portion ( of protective tape)
410 . . . end portion (of protective tape)
420 . . . fastener
430 . . . reflective tape tab

What is claimed is:

1. An inkjet printer having ink cartridge tape removal capability, comprising:

a. a slide bar;

b. an ink cartridge slidably engaging said slide bar, said ink cartridge having an ink ejection orifice; and c. a take-up reel associated with said ink cartridge, said take-up reel having a tape extending therefrom and removably adhering to the ink ejection orifice, the tape peeling from the ink ejection orifice as said ink cartridge slidably engages said slide bar.

2. The inkjet printer of claim 1, further comprising an actuator engaging said take-up red for retracting the tape after the tape peels from the ink ejection orifice.

3. An inkjet printer having ink cartridge tape removal capability, comprising:

a. a frame;

b. an elongate slide bar connected to said frame;

c. a plurality of ink cartridges slidably engaging said slide bar, each of said ink cartridges having an ink ejection orifice formed therein; and d. a take-up reel connected to said frame; said take-up reel having adhesive tape extending therefrom and removably adhering to said ink cartridges for covering the ink ejection orifices, the tape peeling from said ink cartridges for uncovering the ink ejection orifices as said ink cartridges slidably engage said slide bar.

4. The inkjet printer of claim 3, further comprising an actuator connected to said frame and engaging said take-up reel for retracting the tape after the tape peels from said ink cartridges.

5. The inkjet printer of claim 4, wherein said take-up reel comprises a spool.

6. The inkjet printer of claim 5, wherein said actuator comprises:

a. a shaft engaging said spool; and b. a motor engaging said shaft for rotating said shall, so that said spool rotates as said shaft rotates and so that the tape winds about said spool as said spool rotates.

7. The inkjet printer of claim 5, wherein said actuator comprises:

a. an axle engaging said spool;

b. a pinion gear surrounding said axle; and c. a rack connected to said cartridges, said rack having a plurality of gear teeth thereon for engaging said pinion gear, so that said axle rotates as the gear teeth engage said pinion gear, so that said spool rotates as said axle rotates and so that the tape winds about said spool as said spool rotates.

8. The inkjet printer of claim 5, wherein said actuator comprises:

a. a spindle engaging said spool; and b. a spring connected to said spindle for rotating said spindle, so that said spool rotates as said spindle rotates and so that the tape winds about said spool as said spool rotates.

9. The inkjet printer of claim 5, wherein said actuator comprises:

a. an elastomer engaging said spool, said elastomer integrally connected to a first end portion of the tape;

b. an optical sensor disposed adjacent to said cartridges;

c. a reflective tape tab connected to said tape, said tape tab adapted to be in optical communication with said optical sensor, and d. a fastener anchoring a second end portion of the tape.

10. An inkjet printer having ink cartridge tape removal capability, comprising:

a. a frame;

b. an elongate generally cylindrical slide bar affixed to said frame;

c. a carnage slidably engaging said slide bar, said carriage adapted to travel along said slide bar in a first direction and a second direction opposite the first direction;

d. a plurality of adjacent ink cartridges connected to said carriage, each of said ink cartridges having an ink ejection orifice capable of ejecting an ink drop therefrom for marking a recorder medium;

e. a generally cylindrical spool affixed to said frame, said spool having adhesive tape extending therefrom and removably adhering to said ink cartridges for sealably covering the ink ejection orifices, the tape peeling from said ink cartridges to uncover the ink ejection orifices as said ink cartridges slidably engage and slide along said slide bar; and f. an actuator connected to said frame and engaging said spool for retracting the tape after the tape peels from said ink cartridges.

11. The inkjet printer of claim 10, wherein said actuator comprises:

a. a generally cylindrical shaft engaging said spool; and b. a motor engaging said shaft for rotating said shaft, so that said spool rotates as said shaft rotates and so that the tape winds about said spool as said spool rotates.

12. The inkjet printer of claim 10, wherein said actuator comprises:

a. an axle engaging said spool;

b. a pinion gear surrounding said axle and affixed thereto; and c. an elongate rack attached to said carriage, so that said rack travels in the first direction and the second direction as said carriage travels in the first direction and the second direction, said rack having a plurality of gear teeth thereon for engaging said pinion gear, each of said gear teeth having a convex first surface for sliding over said pinion gear as said rack travels in the first direction and a concave second surface, the first surface and the second surface joining to define an edge that engages the gear teeth only as said rack travels in the second direction, so that said axle rotates as the edge of the gear teeth engage said pinion gear, so that said spool rotates as said axle rotates and so that the tape winds about said spool as said spool rotates.

13. The inkjet printer of claim 10, wherein said actuator comprises:

a. a spindle engaging said spool; and b. a coiled spring surrounding said spindle and connected thereto, said spring exerting a torque on said spindle resulting in a force less than force to peel the tape from said cartridges, whereby the torque of said spring rotates said spool as the tape peels from said cartridges and whereby the tape winds about said spool as said spool rotates.

14. The inkjet printer of printer of claim 10, wherein said actuator comprises;

a. an elastomer engaging said spool, said elastomer integrally connected to a first end portion of the tape for winding the tape about said spool;

b. an optical sensor connected to said cartridges, said optical sensor adapted to emit a light beam therefrom;

c. a reflective tape tab connected to said tape and disposed opposite said optical sensor, said tape tab adapted to intercept the light beam emitted by said optical sensor and reflect the light beam back to said optical sensor; and d. a fastener engaging a second end portion of the tape and connected to said frame for anchoring the second end portion of the tape to said frame.

15. A method of assembling an inkjet printer having ink cartridge tape removal capability, comprising the steps of:

a. providing a slide bar;

b. slidably engaging an ink cartridge onto the slide bar, the ink cartridge having an ink ejection orifice; and c. positioning a take-up reel relative to the ink cartridge, the take-up reel having a tape extending therefrom and removably adhering to the ink ejection orifice, the tape peeling from the ink ejection orifice as the ink cartridge slidably engages said slide bar.

16. The method of claim 15, further comprising the step of engaging an actuator with the take-up reel for retracting the tape after the tape peels from the ink ejection orifice.

17. A method of assembling an inkjet printer having ink cartridge tape removal capability, comprising the steps of:

a. providing a frame;

b. connecting an elongate slide bar to the frame;

c. slidably engaging a plurality of ink cartridges onto the slide bar, each of the ink cartridges having an ink ejection orifice formed therein; and d. connecting a take-up reel to the frame, the take-up reel having adhesive tape extending therefrom, the rape removably adhering to the ink cartridges for covering the ink ejection orifices, the tape peeling from the ink cartridges for uncovering the ink ejection orifices as the ink cartridges slidably engage the slide bar.

18. The method of claim 17, further comprising the steps of:

a. connecting an actuator to the frame; and b. engaging the actuator with the take-up reel for retracting the tape after the tape peels from the ink cartridges.

19. The method of claim 18, wherein the step of connecting the actuator to the frame comprises the step of connecting a spool to the frame.

20. The method of claim 19, wherein the step of connecting the actuator to the frame comprises the steps of:

a. engaging a shaft with the spool; and b. engaging a motor with the shaft for rotating the shaft, so that the spool rotates as the shaft rotates and so that the tape winds about the spool as the spool rotates.

21. The method of claim 18, wherein the step of connecting the actuator to the frame comprises the steps of:

a. engaging an axle with the spool;

b. surrounding the axle with a pinion gear; and c. connecting a rack to the cartridges, the rack having a plurality of gear teeth thereon for engaging the pinion gear, so that the axle rotates as the gear teeth engage the pinion gear, so that the spool rotates as the axle rotates and so that the tape winds about the spool as the spool rotates.

22. The method of claim 18, wherein the step of connecting the actuator to the frame comprises the steps of a. engaging a spindle with the spool; and b. connecting a spring to the spindle for rotating the spindle, so that the spool rotates as the spindle rotates and so that the tape winds about the spool as the spool rotates.

23. The method of claim 18, wherein the step of connecting the actuator to the frame comprises the steps of a. engaging an elastomer with the spool, the elastomer integrally connected to a first end portion of the tape for winding the tape about the spool;

b. connecting an optical sensor to the cartridges, the optical sensor adapted to emit a light beam therefrom;

c. connecting a reflective tape tab to the tape, the tape tab disposed opposite the optical, sensor, the tape tab being adapted to intercept the light beam emitted by the optical sensor and reflect the tight beam back to the optical sensor, and d. connecting a fastener to a second end portion of the tape and to the frame for anchoring the second end portion of the tape to the frame.

* * * * *

UNITED STATES PATENT AND TRADEMARK OFFICE

CERTIFICATE OF CORRECTION

PATENT NO. : 6,769,761 B2
DATED : August 3, 2004
INVENTOR(S) : Beilman et al.

It is certified that error appears in the above-identified patent and that said Letters Patent is hereby corrected as shown below:

Title page,
Item [56], References Cited, OTHER PUBLICATIONS, please add: -- Hewlett-Packard Journal, August 1988, pp. 1 - 87 --;

Column 12,
Line 66, delete “red” and insert in lieu thereof -- reel --;

Column 13,
Line 24, delete “shall” and insert in lieu thereof -- shaft --;
Line 59, delete “carnage” and insert in lieu thereof -- carriage --;

Column 14,
Line 45, after “printer”, delete “of printer”;

Column 15,
Line 16, delete “rape” and insert in lieu thereof -- tape --;

Column 16,
Line 26, after “optical” delete “,”;
Line 28, delete “tight” and insert in lieu thereof -- light --.

Signed and Sealed this

Fifteenth Day of February, 2005

JON W. DUDAS
*Director of the United States Patent and Trademark Office*